United States Patent [19]

Sheldon

[11] Patent Number: 4,601,185

[45] Date of Patent: Jul. 22, 1986

[54] KEY IDENTIFIER

[76] Inventor: Richard F. Sheldon, 101 Almond Dr., Albany, Ga. 31705

[21] Appl. No.: 702,912

[22] Filed: Feb. 19, 1985

[51] Int. Cl.[4] ..... A44B 15/00

[52] U.S. Cl. ..... 70/456 R; 70/457; 70/460

[58] Field of Search ..... 70/456 R, 460, 456 B, 70/457, 458; 24/3 K

[56] References Cited

U.S. PATENT DOCUMENTS

| | | | |
|---|---|---|---|
| 2,078,293 | 4/1937 | Smith, Jr. et al. | 70/456 R |
| 2,485,051 | 10/1949 | Joslin | 70/456 R |
| 2,728,501 | 12/1955 | Hill | 70/456 R |
| 4,133,195 | 1/1979 | McLaren | 70/456 R |
| 4,227,389 | 10/1980 | Kartinian | 70/456 R |

FOREIGN PATENT DOCUMENTS

| | | | |
|---|---|---|---|
| 463756 | 3/1950 | Canada | 70/456 R |
| 587671 | 1/1959 | Italy | 70/456 R |

*Primary Examiner*—Gary L. Smith
*Assistant Examiner*—Lloyd A. Gall
*Attorney, Agent, or Firm*—James B. Middleton

[57] ABSTRACT

A key locator allows identification of a given key on a key ring. A flexible tab, or strip of leather or similar material, is folded around the end of a key, and a spring clip holds the strip in place on the key. Holes through both the tab and the clip allow the key to be placed on a conventional key ring in conventional fashion. The tab extends beyond the key and includes a unique identifier so a given key can be easily selected from a group of keys. Several key locators can be placed on keys on the same key ring, and different identifiers can be used on each locator. The locators can be determined by feel alone, and are easily grasped while wearing gloves and the like.

5 Claims, 3 Drawing Figures

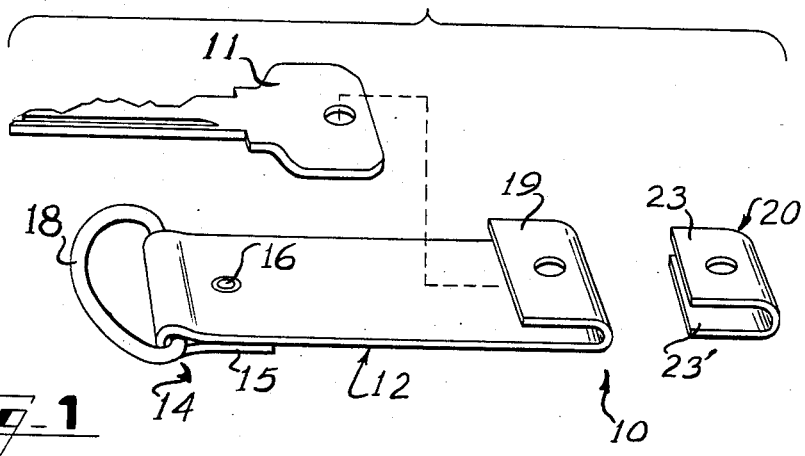
Fig. 1
Fig. 3
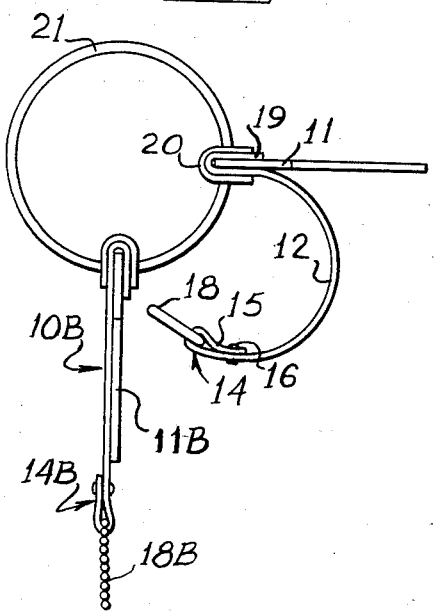
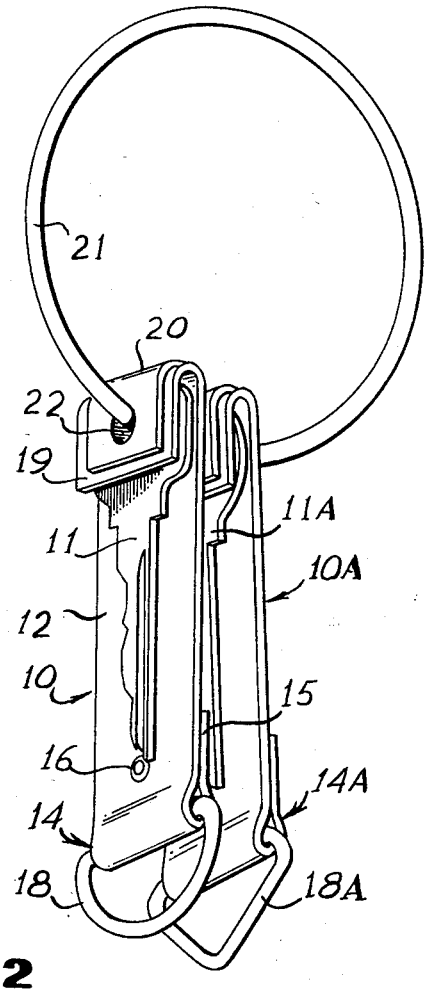
Fig. 2

KEY IDENTIFIER

INFORMATION DISCLOSURE STATEMENT

It is common for a person to carry a rather large number of keys, and of course many of the keys may be sufficiently similar that close examination is required to discern the needed key.

There have been numerous forms of apparatus devised in an effort to allow a person to select a particular key with ease, but these have generally taken the form of additional devices to be placed on a key ring, with the chosen key then attached to the additional device. Such an apparatus may be relatively unhandy even for one key, and would tend to become quite confusing for two or more keys.

Another prior art means for discerning keys has been the use of a cover for the end of the key, various covers being color coded so a person can pick the key having the appropriate color for the appropriate lock. While such a system may be sometimes advantageous, such a system does require that the person visually select the key, and such visual selection may not be possible, for instance in the dark. Alternatively, there is some standardization of shapes of keys, for example the square shape of the ignition as opposed to the round shape of the key for the trunk or the like in an automobile; however, such a system is inoperable when a person has a square door key for his house. There is therefore no simple and desirable system for allowing easy selection of particular keys.

SUMMARY OF THE INVENTION

This invention relates generally to key identification means, and is more particularly concerned with a key locator to be carried adjacent to a given key.

The present invention provides a key locator fixable to a key. The key locator includes means for fixing the locator to the key so the key can be placed on a conventional key ring with the key locator adjacent to the key. The key locator comprises a tab means that extends along the side of the key, the tab extending beyond the end of the key and terminating in a unique identifier. Thus, a plurality of keys on a given key ring can have key locators made in accordance with the present invention, the unique identifier for each of the plurality of keys being unique to the given key. The unique identifiers are preferably identifiable through feel as well as through visual inspection.

BRIEF DESCRIPTION OF THE DRAWINGS

These and other features and advantages of the present invention will become apparent from consideration of the following specification when taken in conjunction with the accompanying drawings in which:

FIG. 1 is an exploded perspective view of a key locator made in accordance with the present invention, and showing one key in conjunction therewith;

FIG. 2 is a perspective view showing two keys with key locators on a key ring, the key locators being of the type shown in FIG. 1; and, FIG. 3 is a plan view showing two keys on a key ring, with the key locator being moved aside for use of the key.

DETAILED DESCRIPTION OF THE EMBODIMENT

Referring now more particularly to the drawings, and to that embodiment of the invention here presented by way of illustration, FIG. 1 shows a key locator 10 made in accordance with the present invention, and showing a key 11 in relationship therewith. The key locator 10 includes a tab designated at 12, the tab 12 terminating in a unique identifier generally designated at 14.

As here illustrated, the preferred form of the invention utilizes a strip of leather or other flexible material as the tab 12, and this flexible material includes a fold 15 at its extending end, the fold being held in place by a brad 16. This fold 15 holds the identification device 18 in place at the end of the tab 12. The identification device 18 shown in FIG. 1 is a D-ring, though of course numerous other materials and shapes may be used.

The opposite end of the tab 12 includes a key retaining means, the means being here shown as a folded portion 19 for holding the key 11, and a clip 20 for retaining the folded portion 19 around the key 11.

It will be obvious to those skilled in the art that the tab 12 may be made of virtually any relatively flexible material including various fabrics, plastics, rubbers and the like. While the folded portion 19 with the spring clip 20 is here shown as a means for holding the key 11 to the locator 10, numerous other means may also be devised. Likewise, the unique indicator 14 can take virtually any form so long as the identification device is unique to each key on the key ring. Using leather, plastics and the like, the end of the tab itself may be shaped to provide the unique indicator 14, and almost any device having a unique shape may be carried by the end of the tab 12 to serve as the identification device.

The preferred arrangement is illustrated to FIG. 1, where it will be noted that the fold 15 is on one side of the tab 12, while the folded portion 19 is on the opposite side of the tab. Though the device will of course work successsfully with both folds on one side, it is preferable to place the key 11 on one side, held by the folded portion 19, and place the fold 15 on the opposite side to prevent interference with the key 11.

Looking now at FIG. 2 of the drawings for an understanding of the use of the key locator 10, it will be seen that there are two key locators 10 and 10A shown on a key ring 21. Looking at the key locator 10, it will be seen that the key 11 has its head portion received beneath the folded portion 19, and the spring clip 20 is received over the folded portion 19 to hold the key 11 in place. In this condition, the key ring 21 is passed through the holes generally designated at 22.

With attention to FIGS. 1 and 2, it will be understood that the tab 12, folded portion 19, and the flanges 23 and 23' of the spring clip 20 have appropriate holes therethrough, and these holes are aligned when the spring clip 20 is in place over the folded portion 19. The conventional hole in the key 11 is also aligned with these holes so the single key ring 21 can pass through all of the holes, and the key is held to the key ring in conventional fashion.

With this arrangement, the key 11 is conventionally held on the key ring 21, but the key locator 10 includes the tab 12 that extends beyond the key itself; and, more specifically, the unique identifier 14 extends beyond the key 11. The key can therefore be treated quite conventionally, but one can select the D-ring 18 and know that the key 11 is associated therewith.

As a further illustration, it will be seen that the key locator 10A carries a key 11A, and the unique identifier 14A includes a triangular ring 18A as an identification device. Thus, the two keys 11 and 11A can be readily discriminated on the basis of the unique identifiers 14 and 14A. Furthermore, because of the readily available unique identifiers 14 and 14A, the particular key can be selected in the dark, utilizing only the tactile clues of the shapes of the rings 18 and 18A, and the fact that the unique indicators 14 and 14A extend beyond the keys 11 and 11A renders manual selection quite simple even though the person may be wearing bulky gloves or the like. Even with relatively limited prehensile ability, one can grasp the unique indicator 14 or 14A, and the rest of the keys on the ring 21 can be allowed to fall away so they will not interfere with the use of the selected key.

Referring now to FIG. 3 of the drawings, use of the key 11 is illustrated. The spring clip 20 assures that the tab 12 is held to the key 11, and the normal integrity of the tab 12 will assure that the tab 12 lies along the side of the key 11 as is shown in FIG. 2. However, when the key 11 is to be used, the fact that the tab 12 is made of leather or other flexible material allows the tab 12 to be moved to the side as shown in FIG. 3 so the key 11 can be inserted into the keyhole.

FIG. 3 also shows a key locator 10B having the unique indicator 14B, the identification device 18B being shown as a bead chain. This is further illustrative of the fact that virtually any item can be held at the end of the tab as an identification device to allow a person to identify a given key.

It will therefore be understood that the device of the present invention provides a key locator that remains in conjunction with a specific key without requiring additional attachments to or extension from an existing key ring. Once the key locator of the present invention is fixed to a given key, the same locator can remain in conjunction with the same key even as a person exchanges key rings and the like; however, if the key must be removed, the key will be removed from the key ring 21 in a conventional manner, and simple removal of the spring clip 20 will allow the key 11 to be removed. Thus, one might select the D-ring as indicating the automobile ignition key, and this indicator can indicate the ignition key even though the person exchanges automobiles, since it is an easy matter to swap keys in the given key locator.

While primarily geometric shapes have been shown as the identification devices 18 and 18A, it will also be recognized that numerous other devices including novelty items such as picture holders, small dice and the like can also be utilized.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or the scope of the invention as defined in the appended claims.

I claim:

1. In a key ring having a plurality of keys thereon, the combination therewith of a plurality of key locators, each key locator of said plurality of key locators being fixed to one key of said plurality of keys, each key locator including a flexible tab adjacent to a key, a unique identifier carried by said tab and extending beyond said key, said unique identifier being unique among said plurality of keys, and a clip for selectively holding said tab to said key, said key ring being receivable through holes defined in said tab and said clip.

2. In a key ring as claimed in claim 1, the further improvement wherein said clip is a spring clip and includes a pair of flanges receivable on opposite sides of said key for assuring that said tab means is adjacent to said key.

3. In a key ring as claimed in claim 2, the further improvement wherein said unique identifier comprises a shape that is identifiable by touch.

4. In a key ring as claimed in claim 3, said unique identifier including a ring carried by the end of said tab, each key locator of said plurality of key locators including a ring of a different shape.

5. In a key ring as claimed in claim 2, said key being received within a folded portion of said tab, said clip being receivable over said folded portion for holding said tab to said key.

* * * * *